US006334519B1

(12) United States Patent
Tong

(10) Patent No.: US 6,334,519 B1
(45) Date of Patent: Jan. 1, 2002

(54) UTILITY BAG THAT CAN BE UNFOLDED

(76) Inventor: Joy Tong, 2932 NW. 27th St. Bldg. 14, Ft. Lauderdale, FL (US) 33311

( * ) Notice: Subject to any disclaimer, the term of this patent is extended or adjusted under 35 U.S.C. 154(b) by 0 days.

(21) Appl. No.: 09/657,589

(22) Filed: Sep. 8, 2000

(51) Int. Cl.[7] ..... A45C 7/00; A45C 3/00

(52) U.S. Cl. ..... 190/107; 190/108; 190/110; 190/111; 190/114

(58) Field of Search ..... 190/113, 114, 190/107, 110, 109, 111, 108

(56) References Cited

U.S. PATENT DOCUMENTS 3,777,862 A * 12/1973 Zipper ..... 190/107 X
4,852,293 A * 8/1989 Levine et al. ..... 190/110 X
4,984,906 A * 1/1991 Little ..... 190/107 X
5,566,797 A * 10/1996 Van Himbeeck ..... 190/107 X
6,039,474 A * 3/2000 DeChant ..... 190/107
6,109,403 A * 8/2000 Godshaw ..... 190/113 X

* cited by examiner

*Primary Examiner*—Allan N. Shoap
*Assistant Examiner*—Tri M. Mai
(74) *Attorney, Agent, or Firm*—Bacon & Thomas, PLLC

(57) ABSTRACT

A utility bag. The bag can be utilized for hanging applications. The bag includes a bag body and an extension hanging pouch. The body includes four folds and two sidings that are deployed on both sides of the fourth fold, such that the four folds will form a pouch with sidings on both sides once the sealing zipper is drawn to close the bag. On top of the fold is provided a hanging hook, which together with a first coupling element provided on a chosen spot inside the fourth fold, makes possible the first coupling element being abutted upon an extension hanging pouch for series application once the body is fully developed and is generally used in a hanging position.

6 Claims, 5 Drawing Sheets

UTILITY BAG THAT CAN BE UNFOLDED

BACKGROUND OF THE INVENTION

1. Field of the Invention

Design of a utility bag including a four-fold piece and two sidings, such that when the bag is folded up, by drawing the correspondingly positioned zipper; a bag is formed, to utilize the bag with a hanger; an extension hanging pouch is attached to the first link element for interconnected application.

2. Description of the Prior Art

Conventional bags come in many varieties, and basically they are executed to have two grips each attached to the top of the bag. Structurally, such a utility bag has a zipper on top of the pouch, or else, in the form of a zipper-bound raise lid which, once raised open, makes possible the loading of objects by way of the opening, or conversely the withdrawing of objects placed therein. The greatest disadvantage with such design is that it leaves little chances of variation, for example, when one brings a few bottles or containers containing cosmetic items for travel, these bottles and containers, that are randomly positioned, may collide with each other when the bag moves is moved. Further, when one needs to use such bottles and containers in, i.e., a hotel, one needs to take them out from the bag one by one, at least until one finds the desired article which is time consuming, and when leaving the hotel the user needs to put the desired articles into the bag.

SUMMARY OF THE INVENTION

The primary object of the invention, therefore, is to provide the design for a utility bag which can be fully expanded and can be used for hanging applications. The invention utility bag includes: a bag body and an extension hanging pouch; the body is composed of four folds and two sidings which are deployed on both sides of the fourth fold; the four folds will form a pouch with sidings on both sides once the sealing zipper is drawn to closure. On top of the first fold is furnished a hanging hook which, together with a first coupling element furnished on a chosen spot inside the fourth fold, which makes possible the first coupling element being abutted upon an extension hanging pouch for series application once the body which is fully developed is meant for use in a pendent, hanging position.

DETAILED DESCRIPTION OF THE PREFERRED EMBODIMENTS

Figure 1:
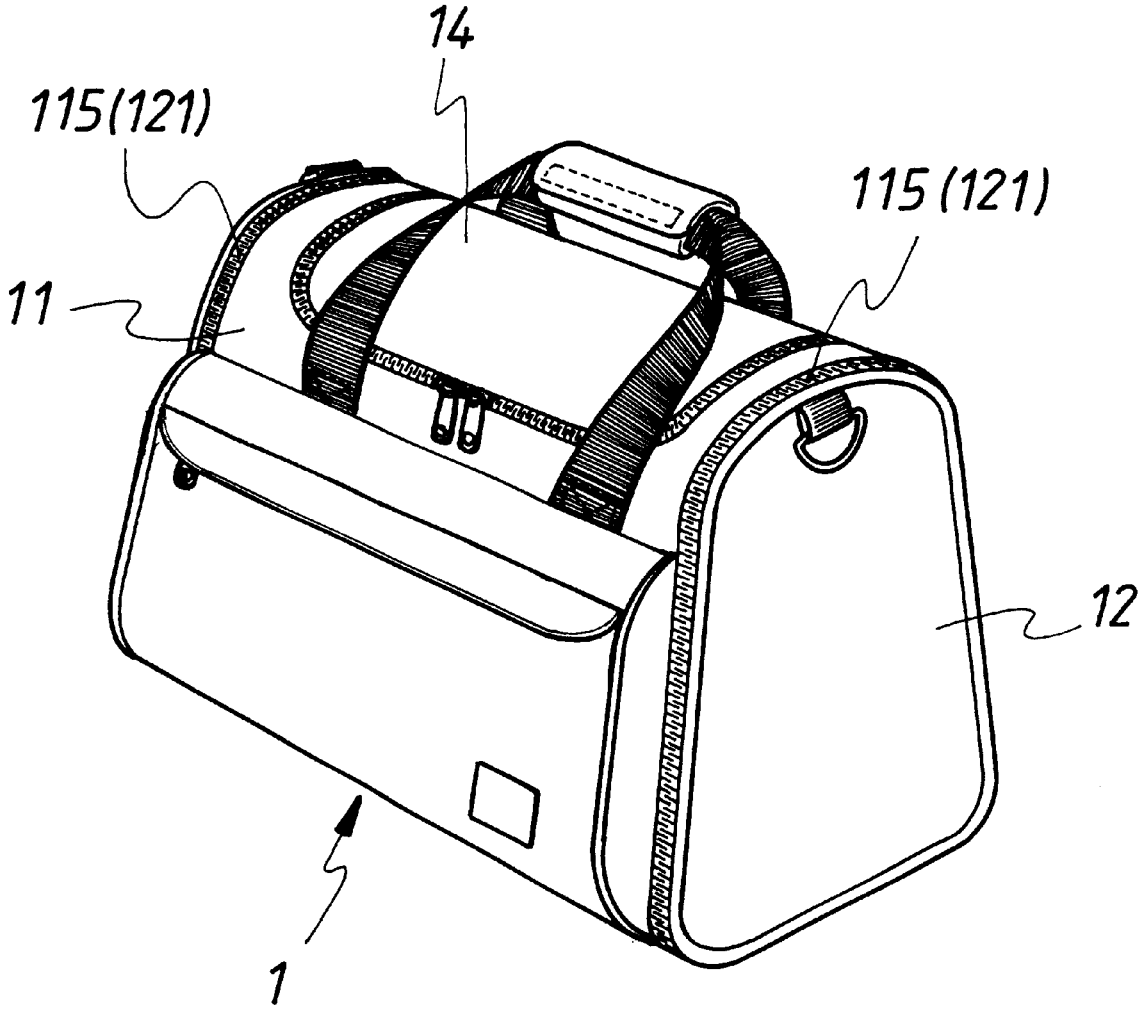
FIG. 1 is a three-dimensional profile of the invention.
Figure 2:
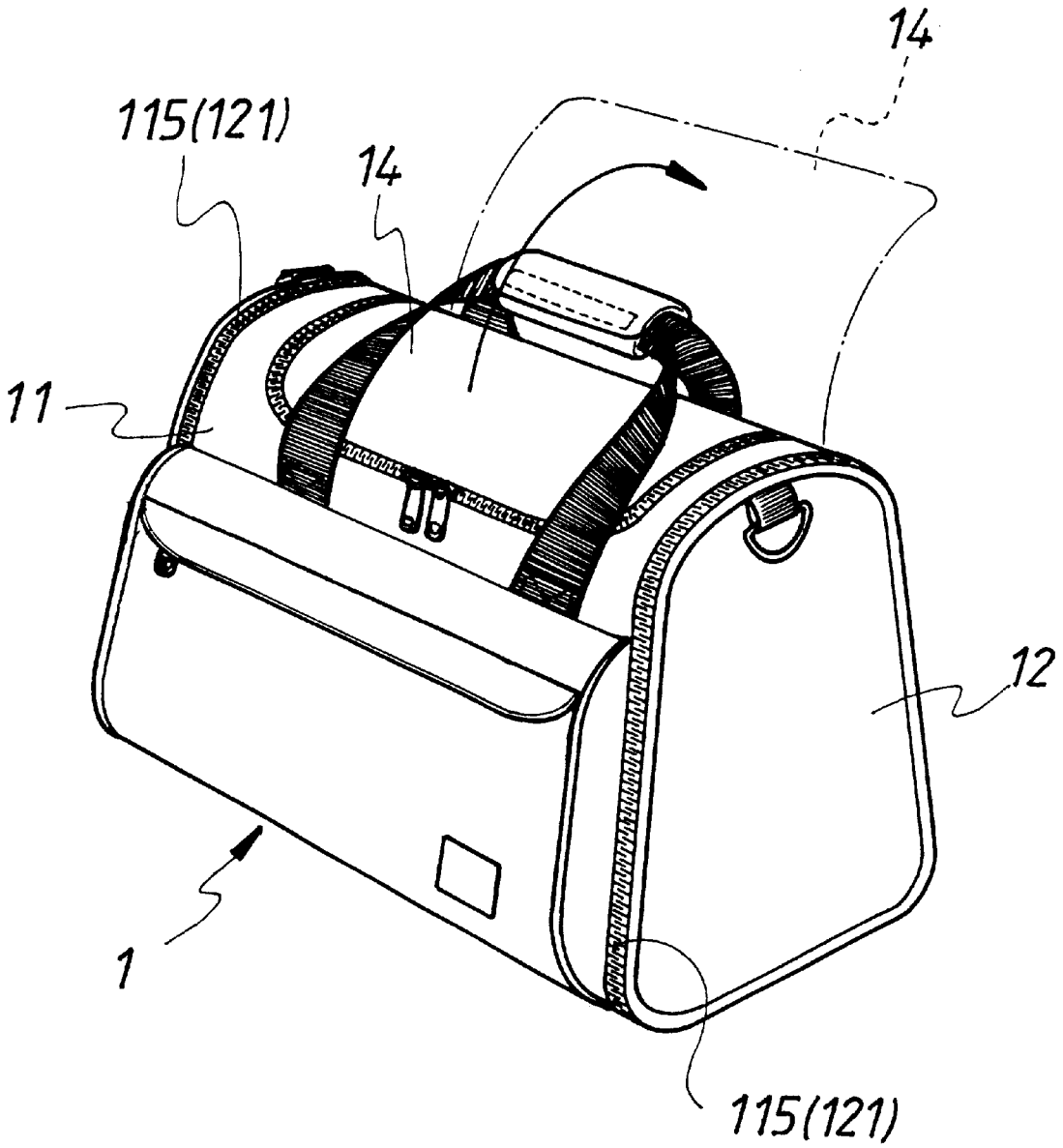
FIG. 2 is an illustration of the invention in a three-dimensional setting.
Figure 3:
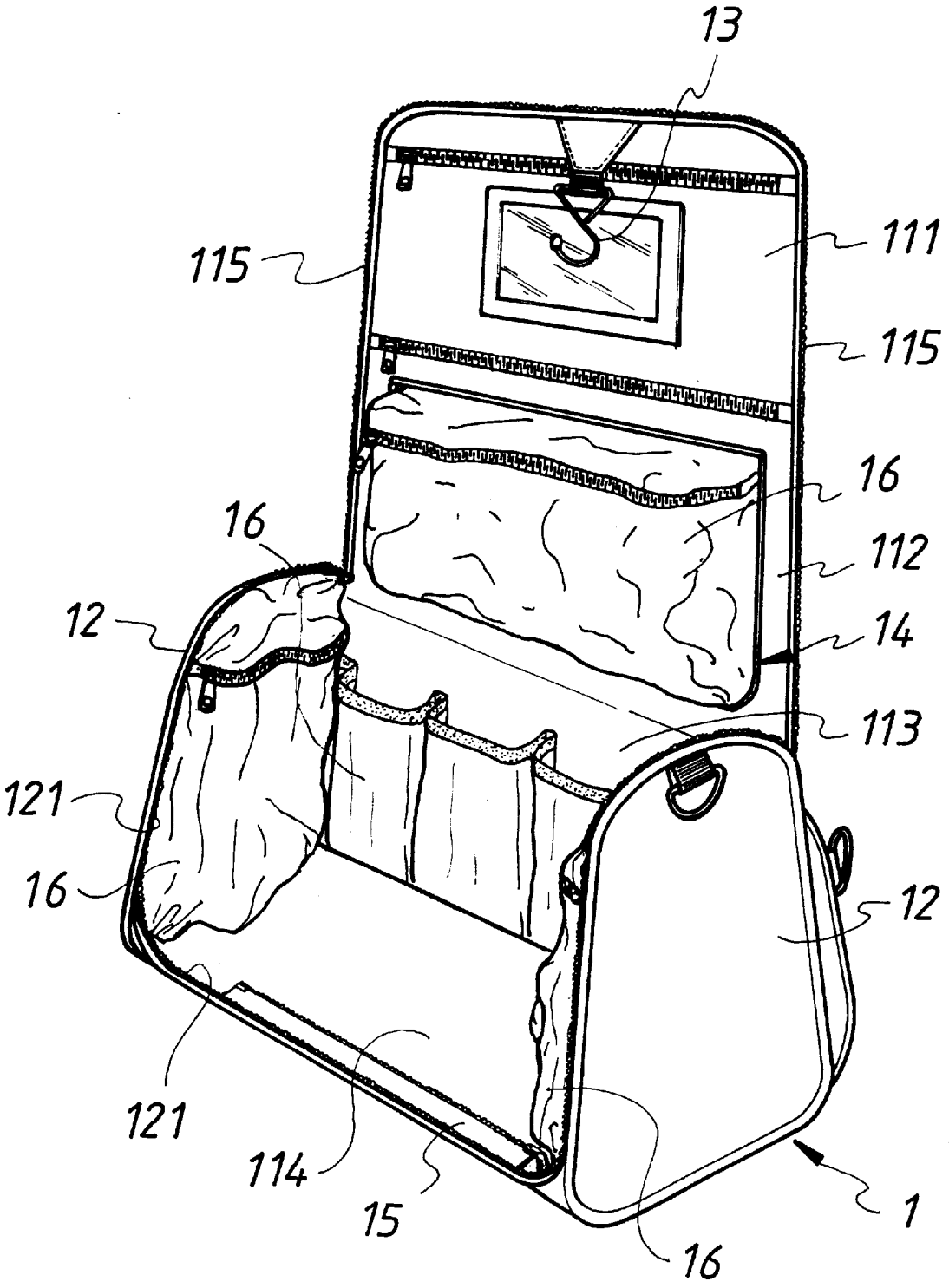
FIG. 3 is a three-dimensional illustration of the invention in an erected open condition.
Figure 4:
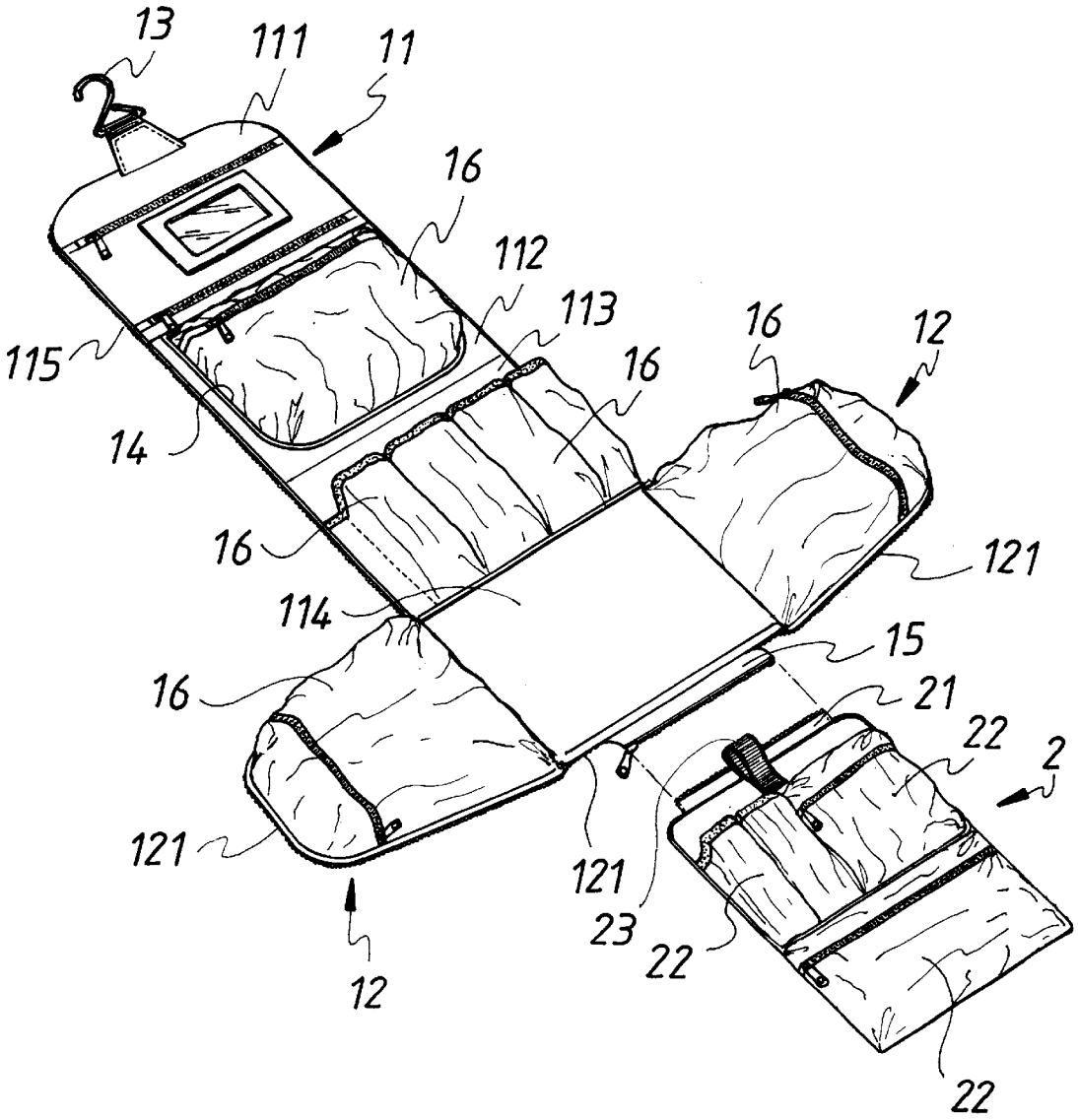
FIG. 4 is a three-dimensional illustration of the invention in a fully expanded state; and, FIG. 5 is an illustration of an embodiment in which the extension pouch is in a state ready for assemblage.

Referring to FIG. 1, it is seen that the invention of a utility bag for hanging application comprises essentially a body 1 and an extension pouch 2, whereof The body 1, as shown in FIG. 3 and FIG. 4, is composed of a four-fold piece 11 and two sidings 12 which are to be coupled to both sides of the fourth fold 114, the first three fold pieces 111, 112 and 113 each has zipper 115 on the outer rim, on the extension of the two siding 12 circumferentially to the tail side of the fourth fold 114 are provided a symmetrical zipper 121, so that by interactive drawing of zipper 115 with zipper 121, the first three fold pieces 11 1, 112, 113 may form a pouch abiding by the contour of both sidings 12, with the first fold piece 111 and the third fold piece 113 being respectively the frontal boarding and the rear boarding of the pouch, on top of the first fold piece 111 is provided a hanging hook 13, while the second fold piece 112 is located on top of the pouch and complete with a raise lid 14 on the center, on a chosen quarter of the interior of the fourth fold piece 114 is provided a first coupling element 15; and the interior of the fourth fold piece 114 and that of the two sidings 12 accommodate sewing to form a container pouch 116 which is made of web texture or tape;

The extension pouch 2, as shown in FIG. 4, is an appendant pouch additional to the bag body 1, on top of the extension pouch 2 may bear a second coupling element 21 by means of which intercoupling is made possible with the first coupling element 15 on the body 1, on one side of said second coupling element 21 is equipped a container bag 22 of which the material is web texture or tape, a lug 23 in addition is provided centrally on top of the extension pouch 2;

Structured accordingly, the bag may serve the purpose of a common bag by opening the raise lid 14 regularly, like what is shown in FIG. 2, while in special occasion or to meet special needs, the closure state of zipper 115 with zipper 121 may be defeated so that the bag may present itself in a fully developed state, whereby hanging is executed by means of the hanging hook 13 on top of the body 1, and that achieving the utmost exploitation of a bag in all its possibilities, in that mode, objects being carried in person may be securely placed into the container bag 16 of the body 1 to facilitate withdrawal for use later on, the extension pouch 2 may be bound to the first coupling element 15 by means of the second coupling element 21 on top, so that the body 1 of the bag may be suitably interconnected in series with the extension pouch 2 for use.

Also, by the design of the invention the extension pouch 2 may be prosecuted in specific pattern pursuant to specific user's needs, more specifically, the second link element 21 may be interconnected with the first link element 15 on the body 1 in a mutually serially connected utility mode, or else in a separately handing utility mode. Where the separate hanging utility mode is the case, the hanging is procured in position with respect to the lug 23 on top of the extension pouch 2, by then, the user may elect a utility mode that best suits his needs to make use of the extension pouch 2, thereby fulfilling its versatility in scope of applications.

Figure 5:
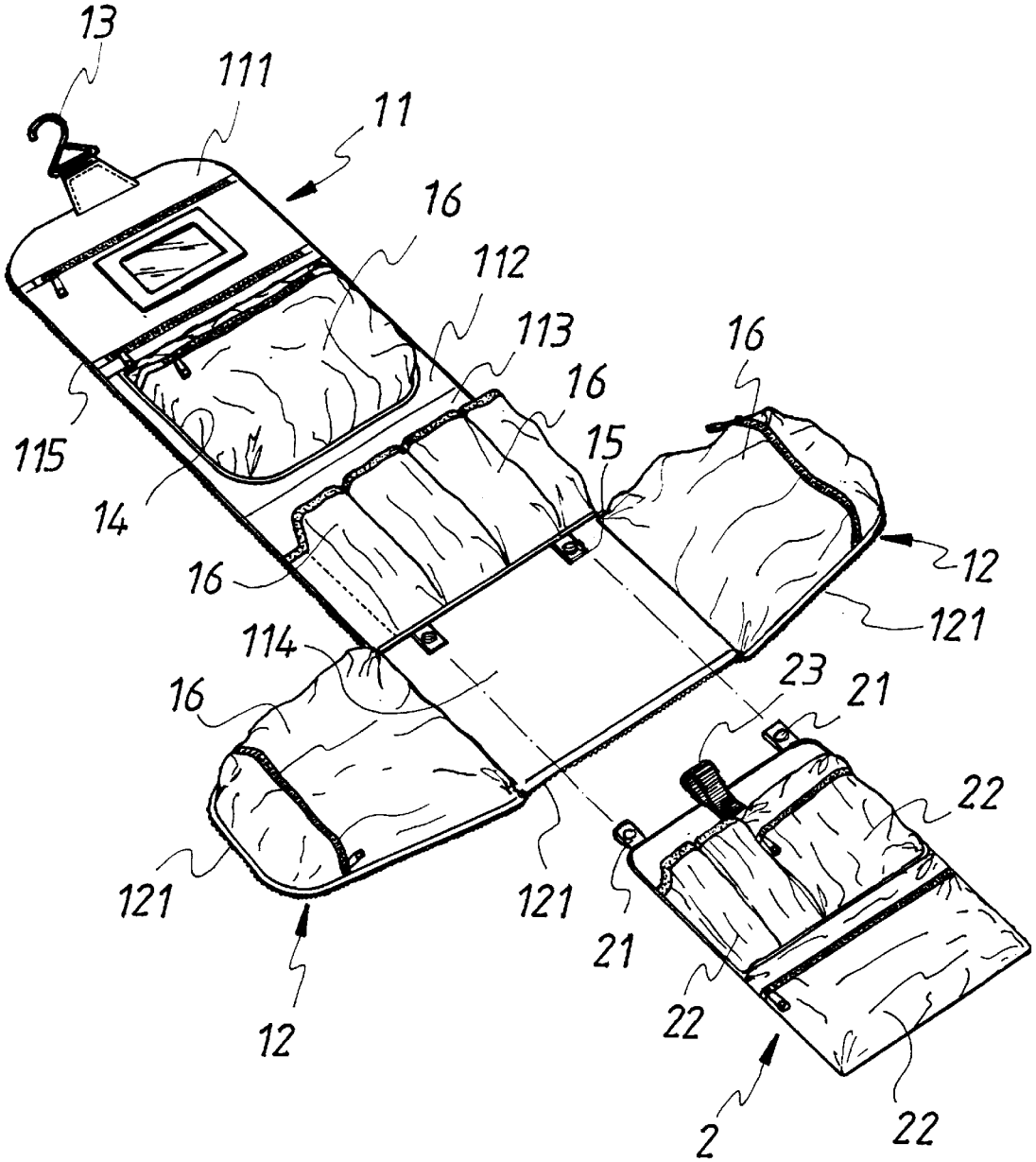

Next, as shown in FIG. 4 and FIG. 5, execution as to interactive coupling of the first link element 15 on the body 1 with the second link element 21 on the extension pouch 2 may be either in terms of zipper chain or button clasping technique, or otherwise. It is to be noted that variants, replacements executed using the know-how and technique taught in this invention, to the extent not departing from the realizable results, shall be deemed covered in the scope of claims.

What is claimed is:

1. A utility bag that can be unfolded, the bag comprising:

a bag body and an extension pouch, the body comprises a four-fold piece and two sidings, the four-fold piece comprises first, second, third and fourth folds sequentially attached to one another, the two sidings are each coupled to opposite sides of the fourth fold;

the first, second and third fold pieces each has a first zipper on an outer rim thereof, on outer rims of the two sidings and the fourth fold is provided a symmetrical zipper, such that by interactive drawing of the first zipper with the symmetrical zipper, the first three fold pieces and the two sidings form a pouch, with the first fold piece and the third fold piece being respectively the frontal boarding and the rear boarding of the pouch;

on top of the first fold piece is provided a hanging hook, while the second fold piece is located on top of the pouch and complete with a raise lid on a center thereof, interiors of both the four fold piece and the two sidings accommodate one or more container pouches;

the extension pouch is an appendant pouch that is additional to the bag body;

a second coupling element on a top side of the extension pouch detachably intercoupling between the second coupling element and the first coupling element on the bag body;

on one side of said second coupling is equipped one or more container bags;

a lug is provided centrally on the extension pouch;

when the utility bag is assembled by attaching outer rims of the four-fold piece and the two sidings, the utility bag serves the purpose of a common bag by allowing opening of the raise lid to permit access to interior portions of the utility bags by partially unzipping the raise lid from the utility bag;

when the bag is brought to a fully expanded state, carried objects may be securely placed in the container pouch within the utility bag and can be withdrawn conveniently; and when said extension pouch is coupled to the first coupling element by the second coupling element, the utility bag can be utilized in combination with the extension pouch.

2. The utility bag as claimed in claim 1, wherein the extension pouch is detached from the utility bag for independent hanging usage.

3. The utility bag as claimed in claim 1, wherein the container pouch provided in the bag body is plural in number.

4. The utility bag as claimed in claim 1, wherein the container pouch provided in the extension pouch is plural in number.

5. The utility bag as claimed in claim 1, wherein the intercoupling of the first coupling element on the bag body with the second coupling element on the extension pouch is executed by zipper chain.

6. The utility bag as claimed in claim 1, wherein the intercoupling of the first coupling element on the bag body with the second coupling element on the extension pouch is executed by snap fasteners attached on the first and second coupling elements.

* * * * *